US009856068B2

(12) United States Patent
Jody

(10) Patent No.: US 9,856,068 B2
(45) Date of Patent: Jan. 2, 2018

(54) ADJUSTABLE THERMALLY INSULATING BEVERAGE JACKET

(71) Applicant: Phillip Lee Jody, Colorado Springs, CO (US)

(72) Inventor: Phillip Lee Jody, Colorado Springs, CO (US)

( * ) Notice: Subject to any disclaimer, the term of this patent is extended or adjusted under 35 U.S.C. 154(b) by 0 days.

(21) Appl. No.: 15/242,749

(22) Filed: Aug. 22, 2016

(65) Prior Publication Data

US 2017/0225871 A1 Aug. 10, 2017

Related U.S. Application Data

(60) Provisional application No. 62/293,122, filed on Feb. 9, 2016.

(51) Int. Cl.
*B65D 25/00* (2006.01)
*B65D 81/38* (2006.01)
*A47G 23/02* (2006.01)

(52) U.S. Cl.
CPC ..... *B65D 81/3876* (2013.01); *A47G 23/0216* (2013.01); *A47G 2023/0291* (2013.01)

(58) Field of Classification Search
CPC ..... B65D 81/3876–81/3886; A47G 23/02–23/0266; A47G 2023/0275–2023/0291
USPC ..... 220/737–739
See application file for complete search history.

(56) References Cited

U.S. PATENT DOCUMENTS 4,197,890 A * 4/1980 Simko ..... A45C 11/20 215/12.1
5,065,879 A * 11/1991 King ..... B65D 81/3886 150/154
5,381,922 A * 1/1995 Gladman ..... A45F 5/02 220/480
6,026,983 A * 2/2000 Graham ..... A47G 23/0216 220/738
6,601,728 B1 * 8/2003 Newkirk ..... A47G 23/0216 220/739
6,799,693 B2 * 10/2004 Meza ..... A45C 7/0077 220/212
9,004,433 B2 * 4/2015 Krieger ..... B60N 3/102 108/165
2004/0173625 A1 * 9/2004 Jones ..... A47G 23/0216 220/739
2007/0017924 A1 * 1/2007 Hundley ..... B65D 81/3876 220/737
2009/0183299 A1 * 7/2009 Conway ..... A44C 5/0007 2/170
2013/0200090 A1 * 8/2013 Dickert ..... B65D 81/3876 220/739
2017/0042356 A1 * 2/2017 Hasani ..... A47G 23/0216

* cited by examiner

*Primary Examiner* — Kareen Thomas

(57) ABSTRACT

An adjustable thermally insulating beverage jacket has two fastener portions disposed at opposite ends of a flexible body portion, which can be attached to each other in order to accommodate a beverage container. The flexible body portion is made of a thermally insulating material to keep beverages cold or warm. A handle insertion portion at one end of the flexible body portion allows use with beverage containers that have handles. A base connected to the bottom edge of the flexible body portion provides a support surface for the bottom of the beverage container.

9 Claims, 3 Drawing Sheets

ADJUSTABLE THERMALLY INSULATING BEVERAGE JACKET

The current application claims a priority to the U.S. Provisional Patent application Ser. No. 62/293,122 filed on Feb. 9, 2015.

FIELD OF THE INVENTION

The present invention relates generally to beverage accessories. More particularly, the present invention relates to adjustable beverage insulators.

BACKGROUND OF THE INVENTION

A koozie, or coozy, is a fabric or foam sleeve that is designed to thermally insulate a beverage container, like a can or bottle. Typical currently available koozies are not adjustable, and are overly simplified with limited adaptability for various sizes and configurations of beverage containers, including mugs and other containers that have handles, making the use of a koozie quite difficult or impossible.

It is therefore an object of the present invention to provide a modified koozie that is adaptable to different sizes of beverage containers, including those that have handles.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

The present invention is a thermally insulating beverage jacket that can be adjusted in diameter in order to accommodate various sizes of beverage containers. The present invention has an open design that is ideal for mugs as the present invention can be connected under the handle.

Figure 1:
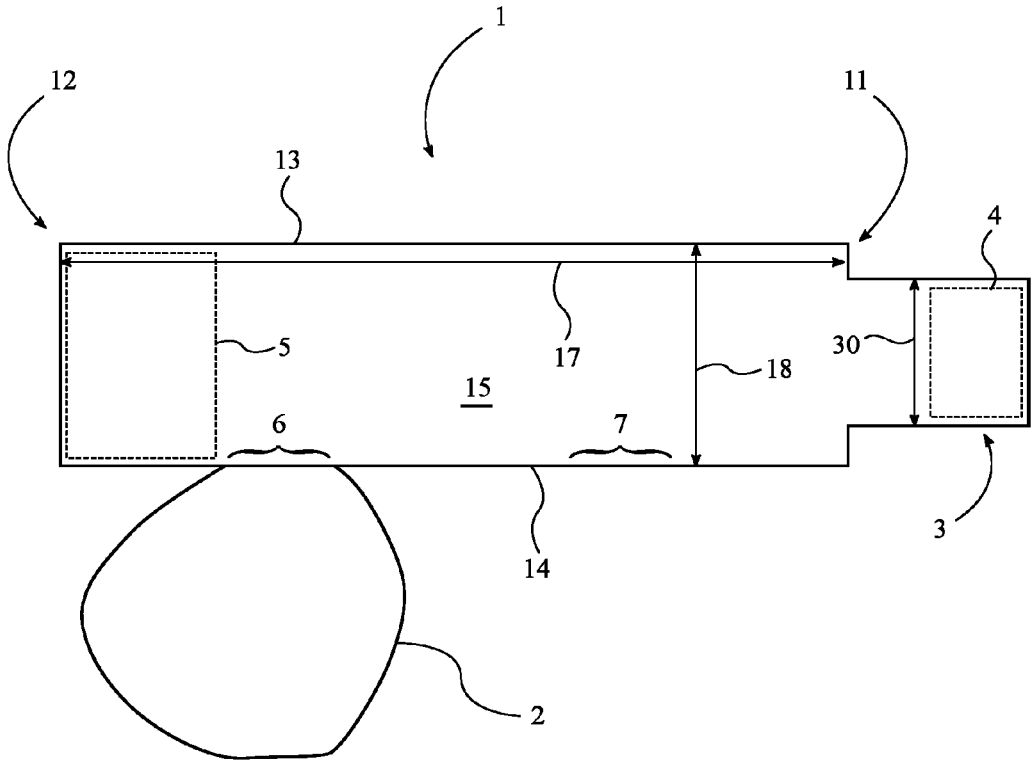
FIG. 1 is a flattened diagram of the present invention with the base portion only connected in one location.
Figure 2:
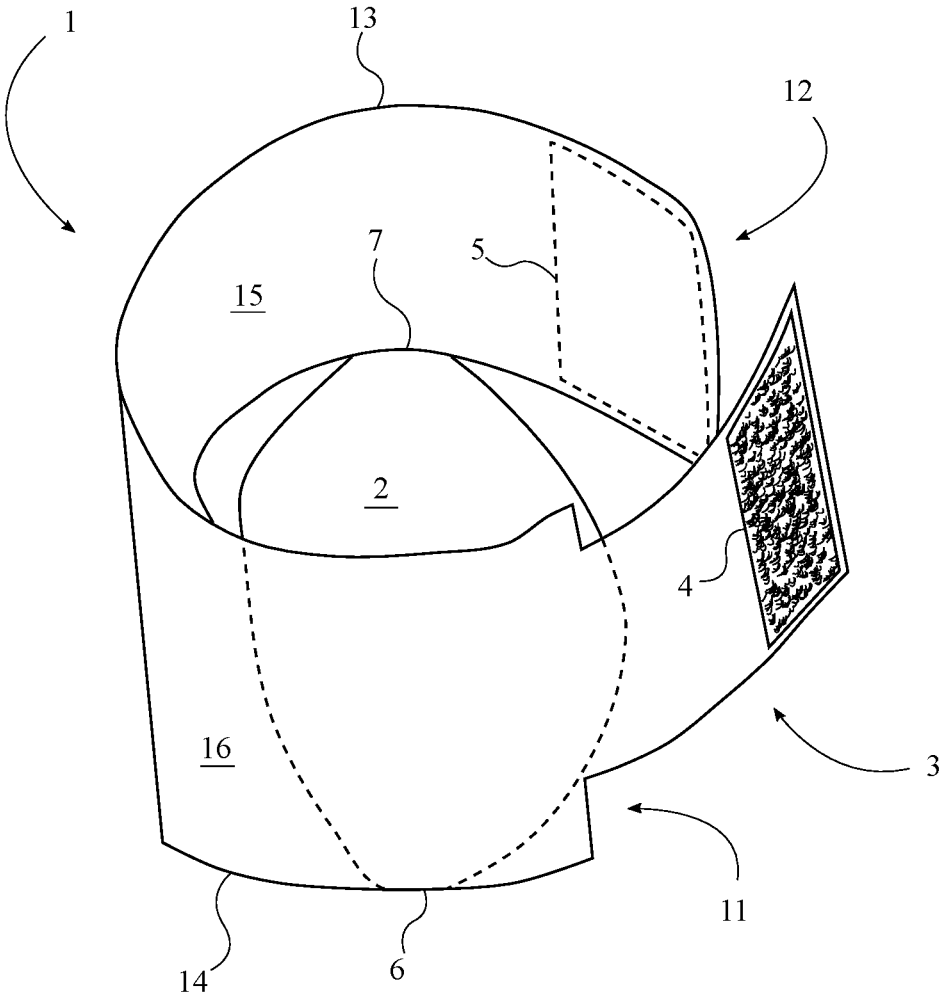
FIG. 2 is an isometric perspective view of the present invention.

Referring to FIGS. 1-2, the present invention generally comprises a flexible body portion 1, a base portion 2, a handle insertion portion 3, a first fastener portion 4, and a second fastener portion 5.

The flexible body portion 1 is the main body of the present invention that, when in use to hold a beverage, forms a lateral insulating wall around the body of the beverage container. In the preferred embodiment of the present invention, the flexible body portion 1 is made of a thermally insulating material. More specifically, in the preferred embodiment the flexible body portion 1 is made of neoprene in order to keep the beverage cold and prevent excessive moisture buildup, although it is acknowledged that the flexible body portion 1 may be made of any suitable material that suits the purposes of flexibility and thermal insulation in order to accommodate and thermally insulate a beverage container. In one alternate embodiment of the present invention could use wool for the material of the present invention.

The flexible body portion 1 is generally rectangular and flat, and comprises a first end 11, a second end 12, an upper edge 13, a lower edge 14, an inner surface 15, and an outer surface 16. A length 17 of the flexible body portion 1 is greater than a height 18 of the flexible body portion 1. The first end 11 and the second end 12 are positioned opposite each other along the length 17 of the flexible body portion 1. The upper edge 13 and the lower edge 14 are positioned opposite each other along the height 18 of the flexible body portion 1. The inner surface 15 and the outer surface 16 are positioned opposite each other along a thickness of the flexible body portion 1.

The base portion 2 is connected to the lower edge 14 of the flexible body portion 1. The base portion 2 supports the bottom of a beverage container while the present invention is in use, and furthermore protects surfaces from condensation if the beverage is set down. In the preferred embodiment, the base portion 2 is connected to the lower edge 14 of the flexible body portion 1 at a first connection location 6 and a second connection location 7. The first connection location 6 and the second connection location 7 are positioned on the lower edge 14 between the first end 11 and the second end 12. The first connection location 6 and the second connection location 7 are separated from each other along the lower edge 14 by approximately half the length 17 of the flexible body portion 1 so that the first connection location 6 and the second connection location 7 are positioned diametrically opposite each other when the first fastener portion 4 and the second fastener portion 5 are attached to each other.

The handle insertion portion 3 is connected adjacent to the first end 11 of the flexible body portion 1 opposite the second end 12. The handle insertion portion 3 has a smaller height 30 than the flexible body portion 1 in order to fit between the handle and body of a mug or other type of container that comprises a handle.

The first fastener portion 4 is connected to the handle insertion portion 3. The second fastener portion 5 is connected to the second end 12 of the flexible body portion 1. The first fastener portion 4 and the second fastener portion 5 may be removably attached to each other in order to attach the first and the second end 12 of the flexible body portion 1 together around a beverage container.

In the preferred embodiment, the first fastener portion 4 and the second fastener portion 5 are positioned on opposite sides of the flexible body portion 1. More particularly, the first fastener portion 4 and the second fastener portion 5 are positioned opposite each other along the thickness of the flexible body portion 1. In one embodiment, the first fastener portion 4 is connected to the inner surface 15 of the flexible body portion 1, and the second fastener portion 5 is connected to the outer surface 16 of the flexible body portion 1. In one embodiment, the first fastener portion 4 is connected to the outer surface 16 of the flexible body portion 1, and the second fastener portion 5 is connected to the inner surface 15 of the flexible body portion 1.

The first fastener portion 4 and the second fastener portion 5 may comprise any type of fastener that facilitates the first end 11 and the second end 12 of the flexible body portion 1 being removably and adjustably attached to each other. In the preferred embodiment, the first fastener portion 4 and the second fastener portion 5 are mating portions of hook and loop tape. The first fastener portion 4 is a portion of hook tape, and the second fastener portion 5 is a portion of loop tape, or vice versa. The portions of hook and loop tape should extend a certain distance towards the middle of the flexible body portion 1, enabling a user to attach the fastener portions to each other at different length 17*s* in order to adjust the beverage accommodating space formed by the interior of the flexible body portion 1 while in use in order to accommodate various sizes of beverage containers.

In another embodiment, the first fastener portion 4 and the second fastener portion 5 are mating portions of a snap button fastener. In this embodiment, multiple rows of snap button fastener portions should be comprised, in order to provide adjustability for different sized containers.

Figure 3:
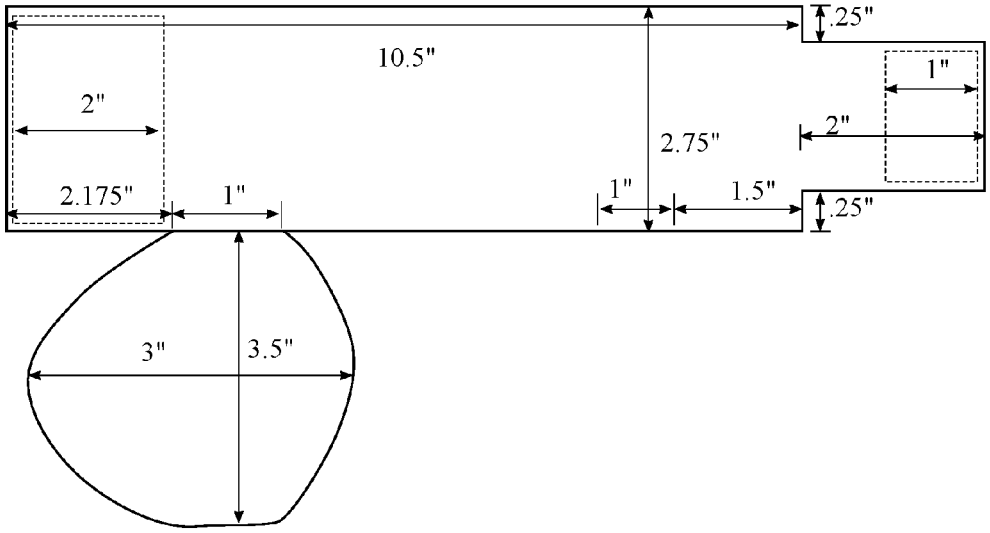
FIG. 3 is a flattened diagram of the present invention showing various dimensions in one embodiment.

Hereinafter is disclosed one specific and exemplary embodiment for the dimensions of the present invention that is not intended to be limiting in any way. Referring to FIG. 3, in one embodiment, the length 17 of the flexible body portion 1 is 10.5 inches, and the height 18 of the flexible body portion 1 is 2.75 inches. The length of the handle insertion portion 3 is 2 inches, and the height 30 of the handle adjustment portion is 2.25 inches. The base is generally oblong but asymmetrical, having a width of 3 inches and a height of 3.5 inches. The first connection location 6 is positioned 2.175 inches from the second end 12 of the flexible body portion 1, and traverses 1 inch along the lower edge 14 toward the first end 11. The second connection location 7 is positioned 1.5 inches from the first end 11 of the flexible body portion 1, and traverses 1 inch along the lower edge 14 toward the second end 12. The first fastener portion 4 is 1 inch in length, and the second fastener portion 5 is 2 inches in length.

Although the invention has been explained in relation to its preferred embodiment, it is to be understood that many other possible modifications and variations can be made without departing from the spirit and scope of the invention as hereinafter claimed.

What is claimed is:

1. An adjustable thermally insulating beverage jacket comprises:

a flexible body portion;

a base portion;

a handle insertion portion;

a first fastener portion;

a second fastener portion;

the flexible body portion comprises a first end, a second end, an upper edge, a lower edge, an inner surface, and an outer surface;

a length of the flexible body portion being greater than a height of the flexible body portion;

the first end and the second end being positioned opposite each other along the length of the flexible body portion;

the upper edge and the lower edge being positioned opposite each other along the height of the flexible body portion;

the inner surface and the outer surface being positioned opposite each other along a thickness of the flexible body portion;

the base portion being connected to the lower edge;

the handle insertion portion being connected adjacent to the first end opposite the second end;

the handle insertion portion having a smaller height than the flexible body portion;

the first fastener portion being connected to the handle insertion portion; and the second fastener portion being connected to the second end, wherein the first fastener portion and the second fastener portion are removably attached to each other in order to attach the first end and the second end of the flexible body portion.

2. The adjustable thermally insulating beverage jacket as claimed in claim 1 comprises:

the flexible body portion being made of thermally insulating material.

3. The adjustable thermally insulating beverage jacket as claimed in claim 1 comprises:

the flexible body portion being made of neoprene material.

4. The adjustable thermally insulating beverage jacket as claimed in claim 1 comprises:

the first fastener portion and the second fastener portion being positioned opposite each other along the thickness of the flexible body portion.

5. The adjustable thermally insulating beverage jacket as claimed in claim 4 comprises:

the first fastener portion being connected to the inner surface of the flexible body portion; and the second fastener portion being connected to the outer surface of the flexible body portion.

6. The adjustable thermally insulating beverage jacket as claimed in claim 4 comprises:

the first fastener portion being connected to the outer surface of the flexible body portion; and the second fastener portion being connected to the inner surface of the flexible body portion.

7. The adjustable thermally insulating beverage jacket as claimed in claim 1 comprises:

the first fastener portion and the second fastener portion being mating portions of hook and loop tape.

8. The adjustable thermally insulating beverage jacket as claimed in claim 1 comprises:

the first fastener portion and the second fastener portion being mating portions of a snap button fastener.

9. The adjustable thermally insulating beverage jacket as claimed in claim 1 comprises:

the base portion being connected to the lower edge of the flexible body portion at a first connection location and a second connection location;

the first connection location and the second connection location being positioned on the lower edge between the first end and the second end; and the first connection location and the second connection location being separated from each other along the lower edge, wherein the first connection location and the second connection location are positioned diametrically opposite each other when the first fastener portion and the second fastener portion are attached to each other.

* * * * *